US006585528B1

(12) United States Patent
Lin et al.

(10) Patent No.: US 6,585,528 B1
(45) Date of Patent: Jul. 1, 2003

(54) WIRE SPACER FOR HIGH SPEED CABLE TERMINATION

(75) Inventors: Yuan-Chieh Lin, Cypress, CA (US); Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,950

(22) Filed: Dec. 20, 2001

(51) Int. Cl.[7] ..... H01R 11/58
(52) U.S. Cl. ..... 439/76.1; 439/942
(58) Field of Search ..... 439/76.1, 610, 439/460, 941, 942

(56) References Cited

U.S. PATENT DOCUMENTS 4,636,024 A * 1/1987 Yahata ..... 439/449
5,281,762 A * 1/1994 Long et al. ..... 174/78
6,080,007 A * 6/2000 Dupuis et al. ..... 439/418
6,290,532 B1 * 9/2001 Vermeersch et al. ..... 439/460

* cited by examiner

*Primary Examiner*—P. Austin Bradley
*Assistant Examiner*—Ross Gushi
(74) *Attorney, Agent, or Firm*—Wei Te Chung

(57) ABSTRACT

A wire spacer (10) is used to reduce the cost of terminating wires (3) of a cable (2) to a cable termination connector assembly (1). The connector assembly includes the wire spacer, a dielectric housing (20), a conductive shroud (30), a printed circuit board (40) and a number of contacts (50). The contacts mount in the housing and are soldered to one end of the PCB. The wires are inserted through holes (17) of the wire spacer (10). Proper positioning of the wires is then more easily verified and stripping the wires and attaching the pair of conductors in each wire to a rear end of the PCB can then be automated. This results in lower production cost. An added advantage is the wire spacer functions as a strain relief for wires of the cable.

9 Claims, 5 Drawing Sheets

WIRE SPACER FOR HIGH SPEED CABLE TERMINATION

BACKGROUND OF THE INVENTION

1. Field of the Invention

The present invention relates to a wire spacer, and particularly to a wire spacer for use in terminating a high speed data transmission cable to a printed circuit board contained in a cable termination connector.

2. Brief Description of the Prior Art

Referring to FIG. 5, a prior art high speed cable termination connector 700 is shown. The connector 700 has a dielectric housing 710, a conductive shroud 720, a printed circuit board 740 attached to a rear side of the housing, and a plurality of contacts 730 each having two ends, the forward end being mounted in the housing 710 and the rearward end being soldered to a connection pad on the printed circuit board 740.

High speed data transmission cables require sophisticated shielding to protect the integrity of the data transmitted. The shielding requirements create many problems during assembly of shielded cable ends. In particular, shielded wires in a cable have to be individually stripped and individually attached to corresponding pads on a rear of a component printed circuit board of a cable termination connector. Problems in organizing the termination of many shielded wires to one small printed circuit board develop. These problems result in greater complexity and cost during assembly of a cable to a cable termination connector.

An apparatus to help organize and simplify the connection of a large number of shielded wires in a shielded cable to a cable termination connector is thus desired.

BRIEF SUMMARY OF THE INVENTION

A first object of the present invention is to provide a wire spacer to help organize a large number of wires in a cable for connection to a printed circuit board in a cable termination connector, in order to reduce cases of miswiring and to decrease production cost;

A second object of the present invention is to provide a wire spacer which can act as a strain relief mechanism to reduce pull stress on wire-PCB solder joints.

To achieve the above-mentioned objects, a wire spacer in accordance with the present invention includes a rectangular, block-shaped, dielectric housing having a plurality of holes defined therein for insertion of shielded wires from a cable therethrough. The wire spacer is used with a cable terminating connector of a prior art design. The prior art connector has a dielectric housing, a plurality of contacts retained in the housing, and a printed circuit board attached by its forward edge to a rear of the housing. Pads adjacent the forward edge of the printed circuit board are electrically connected to the plurality of terminals. The wire spacer abuts a rear edge of the printed circuit board. Wires held in the wire spacer are fixedly positioned and oriented and can be stripped using manual or automatic means, and then can be attached to pads adjacent the rearward edge of the printed circuit board with fewer wiring mistakes. The reliability of this attachment is increased because the wire spacer serves as a strain relief. Production is simplified and becomes more easily automated. Production costs are thereby lowered.

Other objects, advantages and novel features of the present invention will become more apparent from the following detailed description of the present embodiment when taken in conjunction with the accompanying drawings.

DETAILED DESCRIPTION OF THE INVENTION

Figure 1:
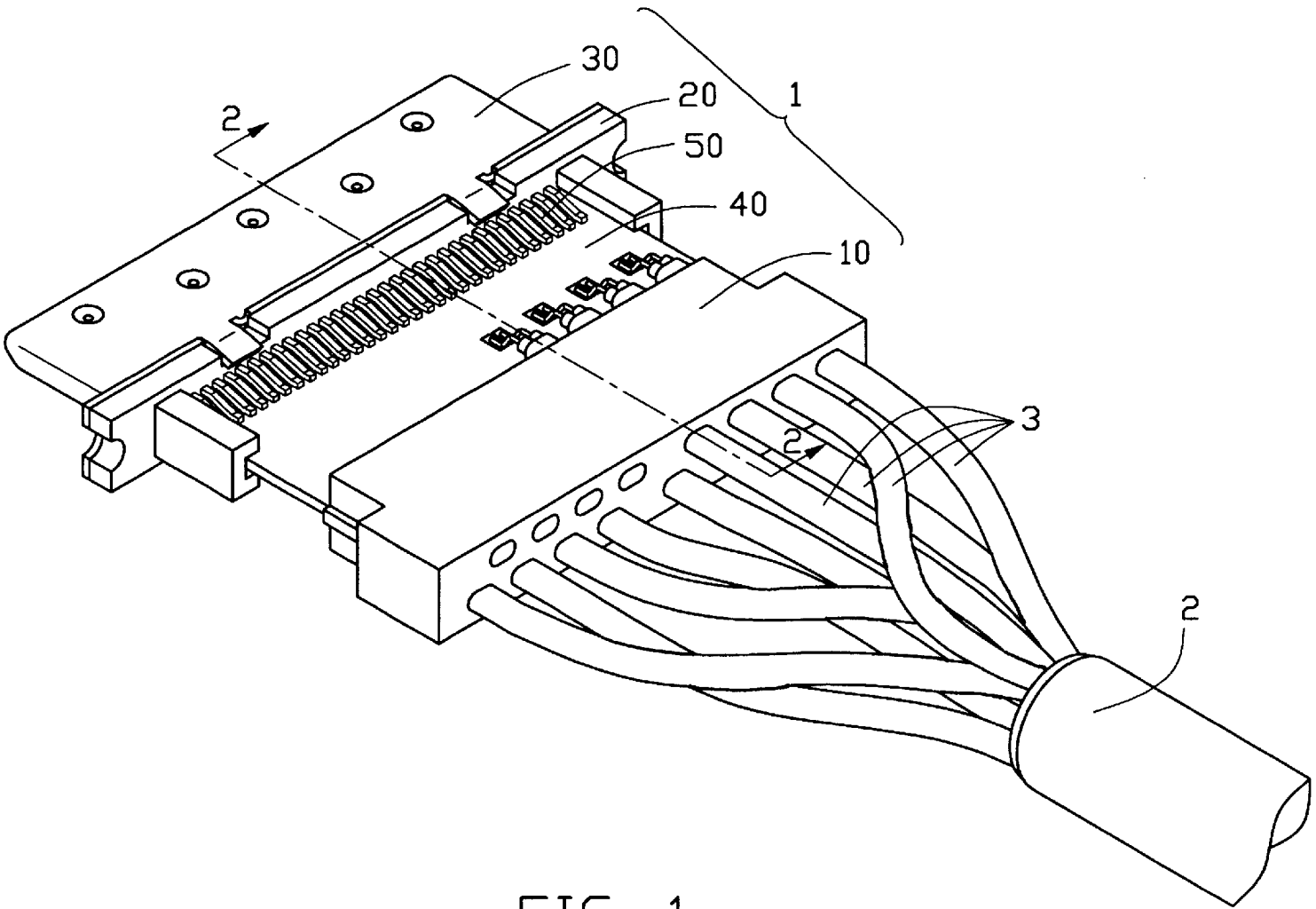
FIG. 1 is an assembled, perspective view of a cable termination connector with a wire spacer in accordance with the present invention, terminating a cable.

Referring to FIG. 1, a dielectric wire spacer 10 of the present invention is shown being used as part of a termination connector assembly 1. The termination connector assembly 1 is shown terminating shielded wires 3 of a high speed data cable 2. Each wire 3 contains a pair of separately insulated conductors (not labeled). The termination connector assembly 1 comprises the dielectric wire spacer 10 of the present invention plus a termination connector (not labeled) comprising a prior art insulative connector housing 20, a prior art conductive shroud 30, a prior art printed circuit board (PCB) 40, and prior art contacts 50.

Figure 2:
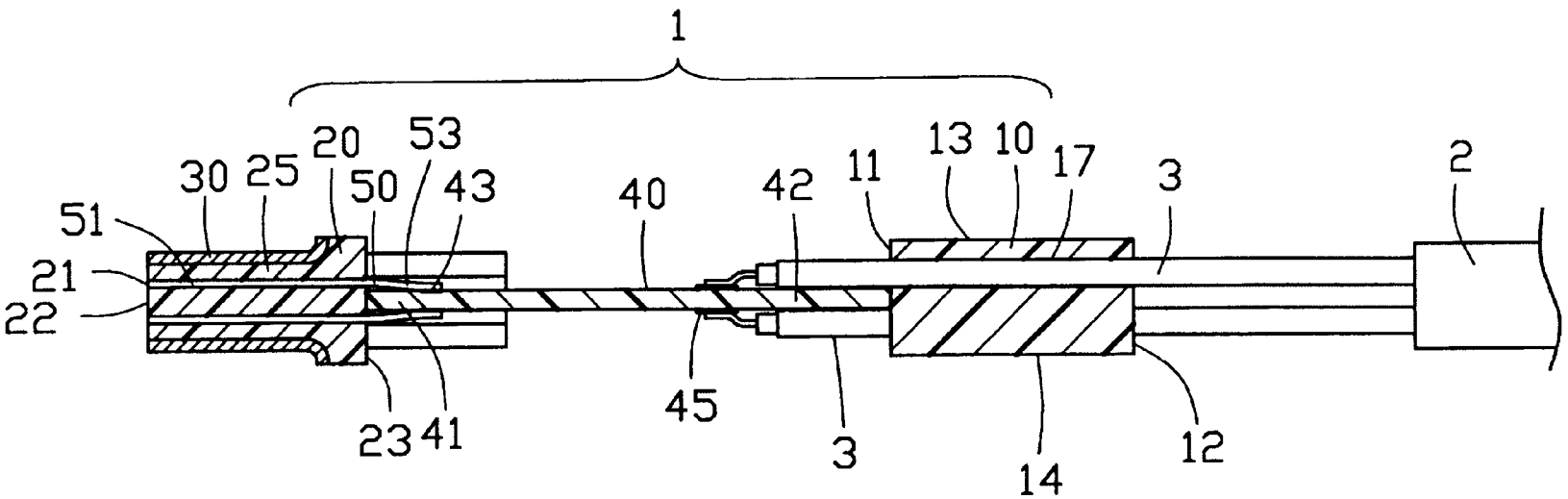
FIG. 2 is a cross-sectional view of the cable and cable connector of FIG. 1, taken along line 2—2.

Referring to FIG. 2, the housing 20 has a plurality of passageways 21 defined from a front face 22 to a rear face 23. The PCB 40 has conductive printed circuit traces (not shown) on one or both its surfaces or in its interior, the printed circuit traces being connected between solder pads 43 along a front edge 41 and solder pads 45 along a rear edge 42 of the PCB 40, as is known in the prior art. The contacts 50 each have two ends, a front end 51 mounted in a corresponding passageway 21 of the housing 20 and a rear end 53 soldered to pads 43 on the PCB 40. The shroud 30 fits over a front end 25 of the housing 20 for electromagnetic interference (EMI) control.

Figure 3:
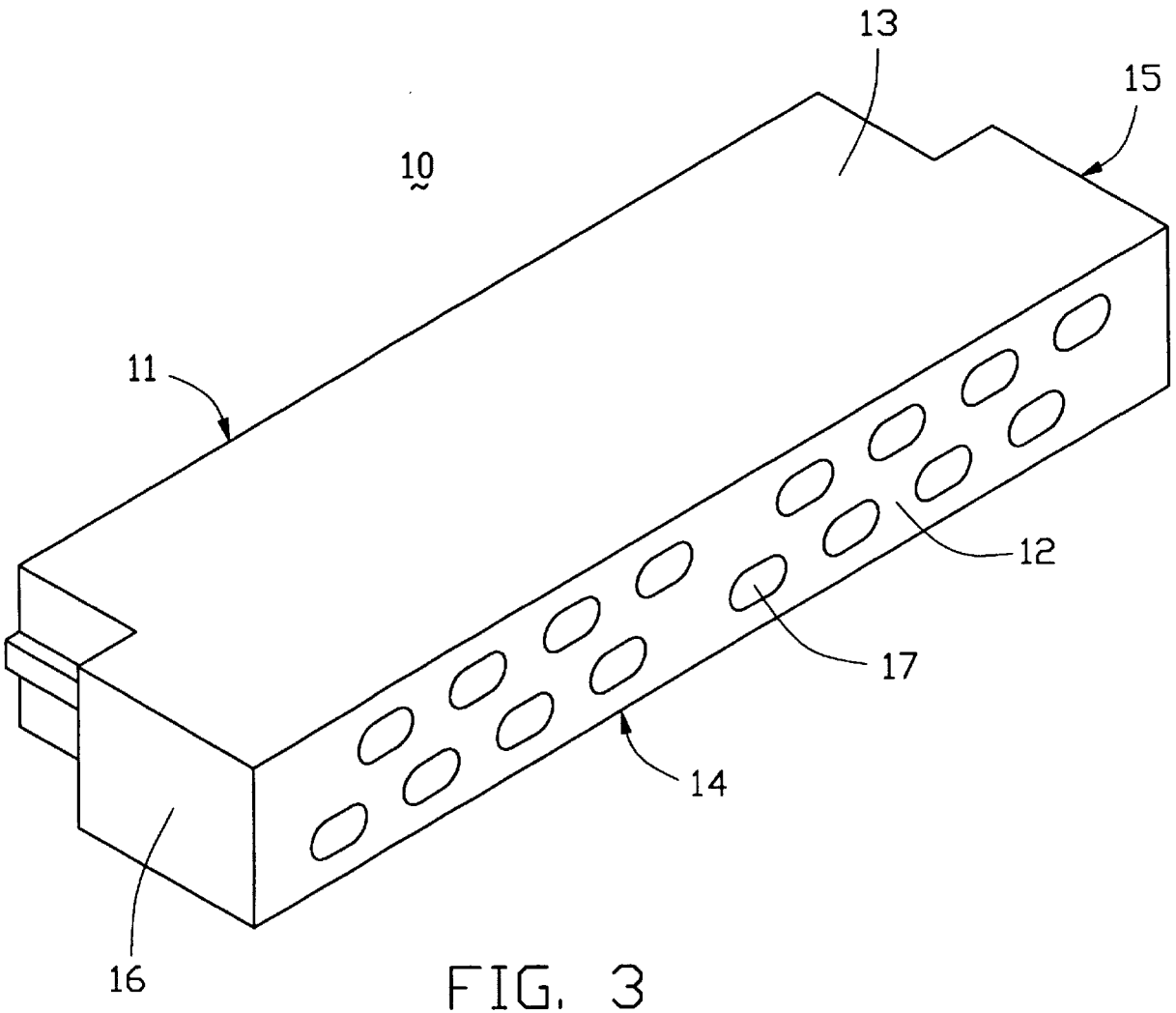
FIG. 3 is a perspective view of the wire spacer of FIG. 1.

Referring to FIG. 3, the wire spacer 10 of the present invention has the shape of an elongate, rectangular block and is made from a dielectric material. The block has a front side 11, a rear side 12, a top side 13, a bottom side 14, a right side 16, and a left side 15. A plurality of parallel holes 17 pass through the wire spacer 10, extending from the front side 11 to the rear side 12. The holes shown each have an oval shape corresponding to the shape of an outside surface of the shielded wires 3 shown, but could be made in whatever shape corresponded to a shape of an outside surface of other wires. The holes are shown arranged in two rows, an upper row for fixing wires having conductors which attach to an upper surface (not labeled) of the PCB 40 and a lower row for fixing wires having conductors which attach to a lower surface (not labeled) of the PCB 40. However, the holes could be arranged in any other number of rows desired for making attachment of conductors to one or more stacked PCBs 40 more convenient.

Figure 4:
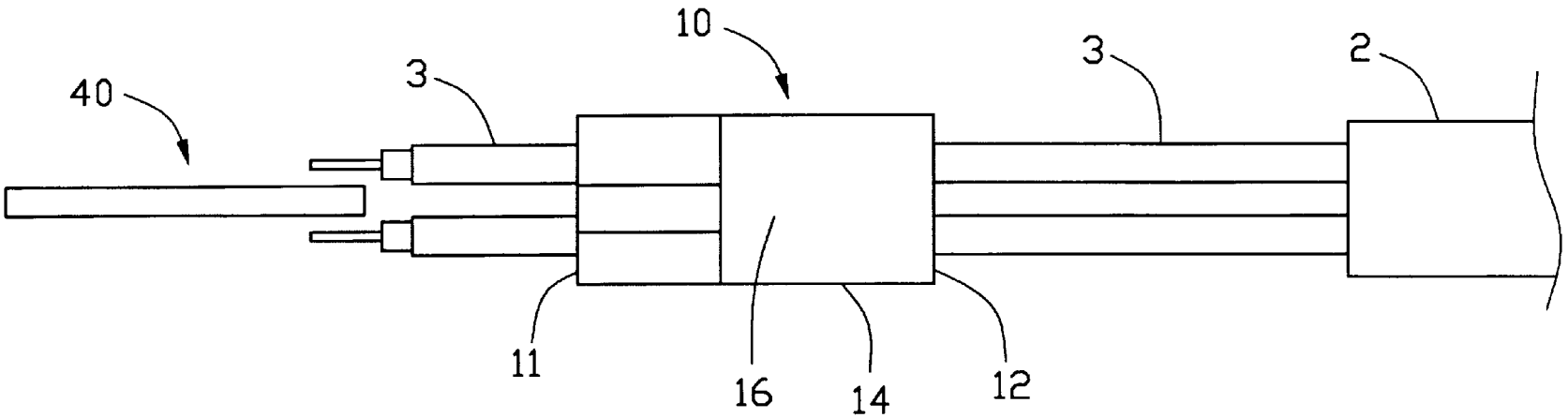
FIG. 4 is a side view of the wire spacer of FIG. 1 with the wires of FIG. 1 assembled therein, and a printed circuit board to which the wires are to be attached.
Figure 5:
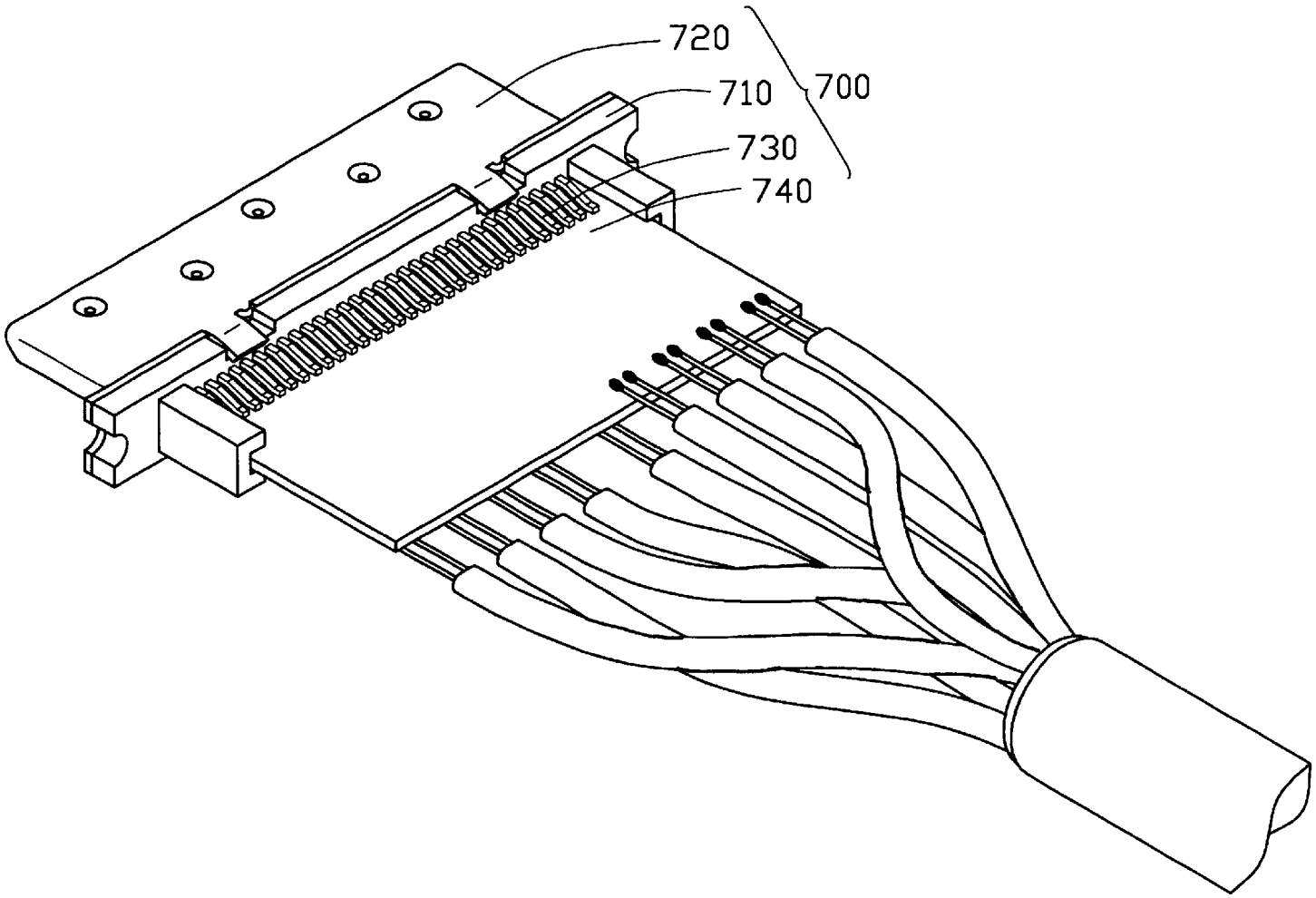
FIG. 5 (PRIOR ART)
FIG. 5 is an assembled, perspective view of a cable termination connector of the prior art, terminating a cable.

In use, ends (not labeled) of wires 3 from the cable 2 are inserted through corresponding holes 17 so that a length of each wire 3 extends in front of the front side 11 of the wire spacer 10 (see FIG. 4). The wires 3 can then be stripped manually or by automatic means. Fixing the wires 3 in the wire spacer 10 makes checking the correct positioning of each wire 3 more easy than when working with free wires 3. Having the wires 3 in a fixed position with a correct orientation also facilitates automated stripping and connection of conductor pairs (not labeled) to the PCB 40. These advantages lower production cost of the terminated cable. Additionally, the wire spacer 10 has the added advantage that it provides strain relief for the wires 3, thus protecting the integrity of the soldered connection between each conductor (not labeled) of each wire 3 and each corresponding solder pad 45. This increases reliability of the finished cable termination.

Obvious improvements and variations to the present invention wire spacer are also intended to be covered in this disclosure. Alternate obvious uses of the present invention wire spacer are also intended to be covered. For instance, to improve the ability of the wire spacer 10 to function as a strain relief, the wire spacer may be fixedly attached to the rear edge 42 of the PCB 40. Furthermore, the wire spacer 10 could be effectively used with other termination connector designs. One such design could be a connector in which the contacts 50 are replaced by golden fingers fixed to a front edge of an alternate embodiment PCB, with a front edge of such PCB extending through an alternate embodiment of the housing 20, allowing connection of the golden fingers to a mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wire spacer for use with a cable termination connector used to terminate an electrical cable containing a plurality of wires, comprising:

a block of dielectric material for being located between the cable termination connector and the cable, the block of dielectric material having a plurality of holes defined therethrough and extending from one side to an opposite side thereof, each hole being open only to the one side and to the opposite side and not to other sides of the block, each hole being for extension of one wire of the plurality of wires therethrough, wherein, when assembled with the cable termination connector, a front side of the wire spacer abuts a rear edge of a printed circuit board, said printed circuit board being a component of the cable termination connector, said printed circuit board having a top surface and a bottom surface, and conductors of the wires attaching to one or both surfaces of the printed circuit board, the wire spacer thereby facilitating organization of the wires for easing connection of each wire to a component of the cable termination connector, while at the same time functioning as a cable strain relief.

2. A cable termination connector assembly for use in terminating an electrical cable containing a plurality of wires, comprising:

an insulative housing defining a slot therethrough;

a printed circuit board having a front edge and a rear edge, a plurality of golden fingers being formed along the front edge and a plurality of solder pads being formed along the rear edge, the front edge of the printed circuit board protruding through the slot of the housing for engagement of the golden fingers with contact surfaces of a mating connector; and a wire spacer made of a block of dielectric material and having a plurality of holes defined therethrough extending from one side of the wire spacer to an opposite side of the wire spacer, each hole being open only to the one side and to the opposite side and not to other sides of the block, the wire spacer abutting against the rear edge of the printed circuit board, and the holes being for extension of the wires of the electrical cable therethrough;

whereby, when the wires of the cable are inserted through the holes in the wire spacer, placement and orientation of the wires with respect to the printed circuit board can be easily checked, and conductors of the wires can be soldered to the solder pads formed along the rear edge of the printed circuit board.

3. The cable termination connector assembly as claimed in claim 2, wherein each wire comprises a pair of separately insulated conductors with a shield wrapped around the pair of conductors, and a cross-section of each wire has an oval shape.

4. A cable termination connector assembly for use in terminating an electrical cable containing a plurality of wires, comprising:

an insulative housing defining a plurality of contact-receiving passages therethrough;

a printed circuit board having a front edge and a rear edge, and a plurality of solder pads formed along the front and rear edges, the front edge of the printed circuit board fixing into a rear of the housing;

a plurality of contacts fixed in the housing and soldered to the solder pads formed along the front edge of the printed circuit board; and a wire spacer made of a block of dielectric material and having a plurality of holes defined therethrough extending from one side of the wire spacer to an opposite side of the wire spacer, each hole being open only to the one side and to the opposite side and not to other sides of the block, the wire spacer abutting against the rear edge of the printed circuit board, and the holes being for extension of the wires of the electrical cable therethrough;

whereby, when the wires of the cable are inserted through the holes in the wire spacer, placement and orientation of the wires with respect to the printed circuit board can be easily checked, and conductors of the wires can be soldered to the solder pads formed along the rear edge of the printed circuit board.

5. The cable termination connector assembly as claimed in claim 4, wherein the holes are parallel to one another and are arranged in two parallel rows.

6. The cable termination connector assembly as claimed in claim 4, wherein the wire spacer is in the shape of a rectangular block.

7. The cable termination connector assembly as claimed in claim 4, wherein the holes have a shape conforming to a cross-section of an outside surface of the wires.

8. The cable termination connector assembly as claimed in claim 7, wherein each wire comprises a pair of separately insulated conductors with a shield wrapped around the pair of conductors, and a cross-section of each wire has an oval shape.

9. A wire spacer for use with a cable termination connector used to terminate an electrical cable containing a plurality of wires, comprising:

a block of dielectric material for being located between the cable termination connector and the cable, the block of dielectric material having a plurality of holes defined therethrough and extending from one side to an opposite side thereof, each hole being for extension of one wire of the plurality of wires therethrough, wherein, when assembled with the cable termination connector, a front side of the wire spacer fixedly attaches to a rear edge of a printed circuit board, said printed circuit board being a component of the cable termination connector, said printed circuit board having a top surface and a bottom surface, and conductors of the wires attaching to one or both surfaces of the printed circuit board, the wire spacer thereby facilitating organization of the wires for easing connection of each wire to a component of the cable termination connector, while at the same time functioning as a cable strain relief.

* * * * *